US005849964A

United States Patent [19]

Holighaus et al.

[11] Patent Number: 5,849,964

[45] Date of Patent: Dec. 15, 1998

[54] PROCESS FOR THE PROCESSING OF SALVAGED OR WASTE PLASTIC MATERIALS

[75] Inventors: Rolf Holighaus, Haltern; Klaus Niemann, Oberhausen; Martin Rupp, Essen, all of Germany

[73] Assignee: Veba Oel Aktiengesellschaft, Gelsenkirchen, Germany

[21] Appl. No.: 525,750

[22] PCT Filed: Mar. 25, 1994

[86] PCT No.: PCT/EP94/00954

§ 371 Date: Dec. 27, 1995

§ 102(e) Date: Dec. 27, 1995

[87] PCT Pub. No.: WO94/22979

PCT Pub. Date: Oct. 13, 1994

[30] Foreign Application Priority Data

Apr. 3, 1993 [DE] Germany ..... 43 11 034.7

[51] Int. Cl.[6] ..... C07C 1/00

[52] U.S. Cl. ..... 585/241

[58] Field of Search ..... 585/241, 250

[56] References Cited

U.S. PATENT DOCUMENTS

| | | | |
|---|---|---|---|
| 4,982,027 | 1/1991 | Korff et al. | 585/241 |
| 5,070,109 | 12/1991 | Ulick et al. | 521/41 |
| 5,079,385 | 1/1992 | Wu | 585/241 |

*Primary Examiner*—Glenn Caldarola
*Assistant Examiner*—Thuan Dang
*Attorney, Agent, or Firm*—Oblon, Spivak, McClelland, Maier & Neustadt, P.C.

[57] ABSTRACT

A process is disclosed for processing used or waste plastic materials in order to recover chemical raw materials and liquid fuel components by depolymerisation of the used materials, which are transformed into a pumpable and into a volatile phase. The volatile phase is separated into a gaseous phase and a condensate or condensable depolymerisation product, which are refined by standard usual procedures. The pumpable phase remaining once the volatile phase is separated is subjected to liquid phase hydrogenation, gasification, low temperature carbonisation or to a combination of said processes.

17 Claims, 3 Drawing Sheets

PROCESS FOR THE PROCESSING OF SALVAGED OR WASTE PLASTIC MATERIALS

BACKGROUND OF THE INVENTION

1. Field of the Invention

The invention relates to a process for the processing of salvaged or waste plastics materials for the purpose of extracting chemical starting materials and liquid fuel components.

2. Discussion of the Background

The invention is based on a process for the hydrotreating of carbon-containing material, whereby polymers, in particular polymer wastes in comminuted or dissolved form, are added to a high-boiling oil, and this mixture is subjected to a hydrogenation treatment in the presence of hydrogen in order to extract fuel components and chemical starting materials (cf. DD 254 207 A1).

A process to convert used tyres, rubber and/or other plastics materials into liquid, gaseous and solid products by means of a depolymerizing treatment in a carrier under increased pressure and elevated temperature has been described in DE-A25 30 229. It was, in particular, intended that no harmful substances, such as $SO_2$, carbon black or the like, should reach the atmosphere. Used tyres, for example, after comminution and mixing with a recycle oil from the hydrogenation product are admitted to a hydrogenation reactor with the addition of hydrogen at a hydrogen pressure of 150 bar and at a temperature of 450° C. in the presence of substances which catalyse the cracking and hydrogenation reactions.

DE-A-2 205 001 describes a process for the thermal processing of waste matter and unvulcanized rubber, whereby the waste matter is cracked at temperatures of 250° to 450° C. in the presence of an auxiliary phase which is fluid at the reaction temperature.

In addition, reference is made to a paper by Ronald H. Wolk, Michael C. Chervenak and Carmine A. Battista in Rubber Age, June 1974, pages 27 to 38, regarding the hydrogenation of waste tyres for the purpose of extracting hydrocarbon-based liquid products, which have a boiling point in the gas oil range, and carbon black which can be re-used as a filler material.

Furthermore, a process is known whereby polymer wastes, in particular salvaged rubber, are dissolved in the residual products from the processing of crude oil. The resultant mixture is then subjected to a coking process to produce coke. In so doing, gaseous and fluid products are obtained. According to DD 0 144 171, the latter are said to be suitable as fuel components, after appropriate processing.

According to the process according to DD 254 207, the polymer concentration in the hydrogenation starting product is, for example, between 0.01 to 20% by mass. The joint hydrogenating treatment of heavy oils with dissolved and/or suspended polymers should be restricted to hydrogenation processes in which the hydrogenation is carried out in tube reactors with or without a suspended catalyst. If reactors were to be operated using catalysts in a fixed bed, the use of polymers would be possible only to a limited degree, in particular when polymers which depolymerize already in the heating-up phase up to about 420° C. before entry into the reactor were to be used.

The object, at this point, in processes to process salvaged plastics materials, is that there should not be a restriction to additions of only up to 20% by mass of salvaged plastics material to heavy oil conversion processes which are typical for oil refineries.

A further problem arises in that, in the chemical conversion of plastics-containing waste products, chlorine-containing plastics materials must also be simultaneously processed. The corrosive halogen hydrides, which appear in the form of gaseous cracking products during depolymerization according to the state of the art processes, necessitate specific precautionary measures.

A further problem arises in that the waste or salvaged plastics materials in part contain not inconsiderable quantities of inorganic secondary components, such as pigments, metals and fillers, which may, in certain depolymerization processes, e.g. in the reprocessing of depolymerization products, lead to difficulties.

It is, therefore, also the object of the present invention to provide a process which tolerates these components. Said components are upgraded in a phase, whence they can be directed to reprocessing processes, in which these components are also tolerated, while other phases, which are free of these inorganic secondary components require a less complicated reprocessing procedure.

SUMMARY OF THE INVENTION

A further object includes that relief should be provided in complex and capital-intensive process steps, such as low-temperature carbonization, gasification or liquid phase hydrogenation, with regard to the required throughput quantities, or that they should be better utilized.

The invention consists of a process for the processing of salvaged or waste plastics materials for the purpose of extracting chemical starting materials and liquid fuel components by depolymerizing the starting materials to produce a phase which can be pumped and a volatile phase, separation of the volatile phase into a gaseous phase and a condensate, or condensable depolymerization products which are subjected to standard procedures which are usual in oil refineries, the phase which can be pumped and remains after separation of the volatile phase being subjected to a liquid phase hydrogenation, gasification, low-temperature carbonization, or to a combination of said procedural steps.

In said process, the resultant gaseous depolymerization products (gas), the resultant condensable depolymerization products (condensate), and the liquid phase (depolymerizate) which can be pumped and contains viscous depolymerization products, are drawn off in separate partial flow streams, and the condensate and the depolymerizate are worked up separately. In this regard, the process parameters are preferably selected such that the highest possible quantity of so-called condensate is produced.

Additional advantageous developments of the invention are described in the subordinate claims.

Figure 1:
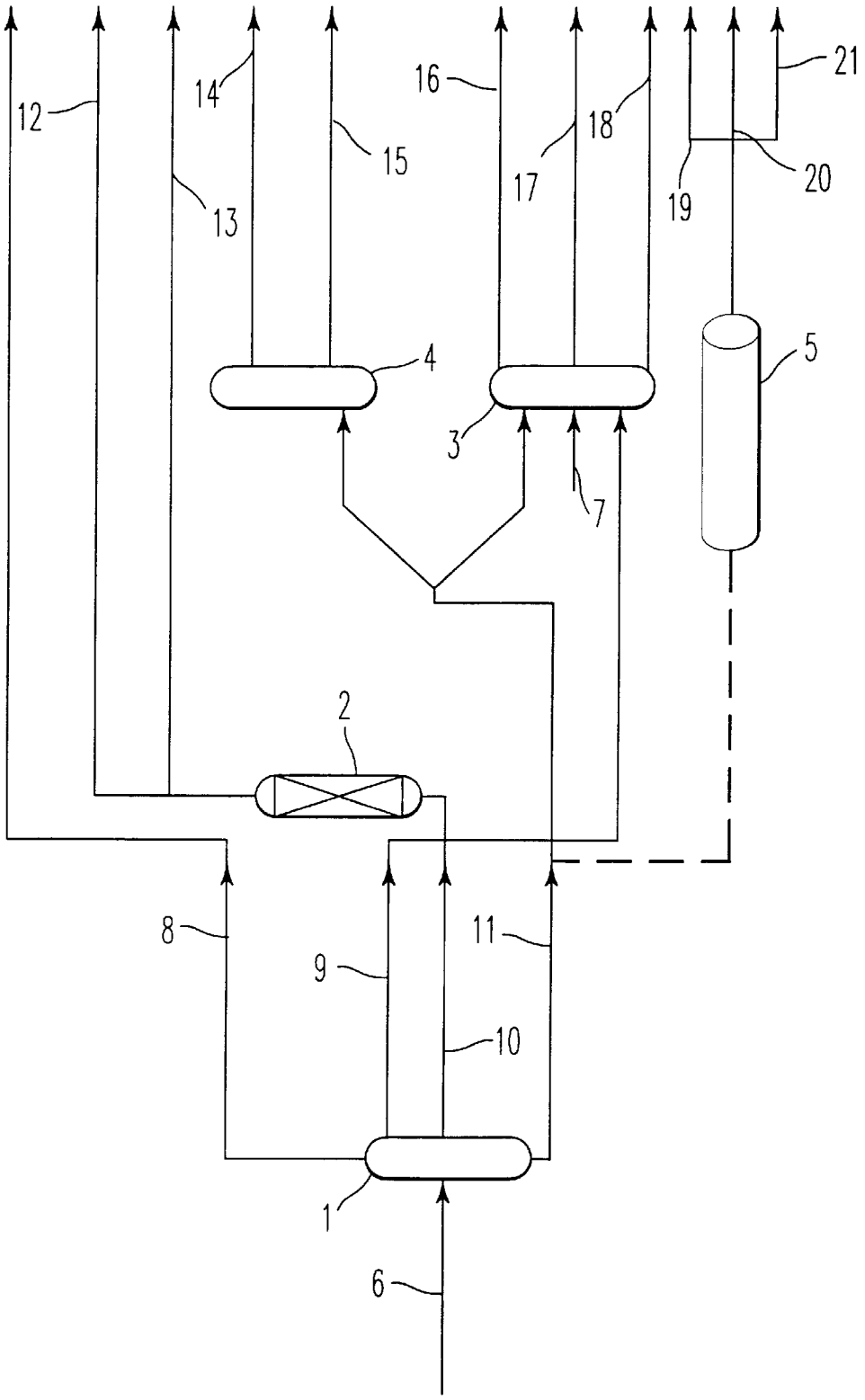
FIG. 1 diagrammatically shows a plant which can be used to conduct the process of the invention.

The plastics materials which are to be used in the present process are, for example, mixed portions from refuse collections, amongst others by Duale System Deutschland GmbH (DSD). These mixed portions contain, for example, polyethylene, polypropylene, polyvinyl chloride, polystyrene, polymer blends such as ABS, and polycondensation products. Wastes from the production of plastics materials, commercial packaging wastes of plastics materials, residues, mixed and pure portions from the plastics-processing industry, can also be used, the chemical composition of said plastics material wastes not being critical as a criterion for suitability for use in the present process. Suitable starting products also include elastomers, technical rubber items or salvaged tyres in a suitably comminuted form.

The salvaged or waste plastics materials are derived, for example, from shaped parts, laminates, composite materials, foils or sheets, or from synthetic fibres. Examples of halogen-containing plastics materials are chlorinated polyethylene (PEC), polyvinyl chloride (PVC), polyvinylidene chloride (PVDC), chloroprene rubber, to name but a few important members of the group. In particular sulphur-containing plastics materials, for example polysulphones or rubbers cross-linked with sulphur bridges, as in salvaged tyres, are, however, also obtained in large quantities and are suitable for depolymerization and further processing to extract chemical starting materials or even fuel components, provided that the appropriate equipment for prior comminution and pre-sorting into plastics components and metal components is available. The sulphidic sulphur obtained during these preliminary treatment steps or chemical conversion processes with the addition of hydrogen in the process for the greater part passes over into the waste gas, as does the hydrogen chloride, said waste gas being separated off and directed onward for further processing.

Synthetic plastics materials, elastomers, but in addition also modified natural substances, are included in the salvaged or waste plastics materials which can be used in the present process. In addition to the above-mentioned polymers, said modified natural substances include, in particular, thermoplastics, but also duroplastics and polyaddition compounds, as well as products based on cellulose such as pulp and paper. The products manufactured of said materials include semi-finished products, piece parts, structural components, packaging, storage and transportation containers, as well as consumer articles. The semi-finished products also include slabs, plates and boards (printed circuit boards) as well as laminated sheets which may, in part, still contain metal coatings and, as in the case of the other products to be used, may be separated, if required, from metal components, glass or ceramics components by means of suitable separating processes, after a preliminary comminution to particle or part sizes of 0.5 to 50 mm.

The above-mentioned salvaged and waste plastics materials, as a rule, also contain inorganic secondary components such as pigments, glass fibres, fillers such as titanium oxide or zinc oxide, flame-proofing agents, pigment-containing printing inks, carbon black and even metals, such as, for example, elemental aluminium. The above-mentioned salvaged or waste plastics materials, which may be obtained in mixtures or batches of varying compositions, for example from collections by the DSD, may contain up to 10% by mass, optionally up to 20% by mass of inorganic secondary components. Said mixtures of plastics materials are usually used in the present process in comminuted or even preconditioned form, e.g. as a granulate or chips or the like.

The depolymerization process products are, essentially, divided into three main product flow streams:

1.) A depolymerizate, in a quantity of between 15 and 85% by mass, relative to the mixture of plastics material used, which may, depending on the composition and the respective requirements, be divided into partial product flow streams which are to be directed to liquid phase hydrogenation, pressure gasification and/or low-temperature carbonization (pyrolysis).

What is involved here are predominantly heavy hydrocarbons with a boiling point >480° C. which contain all the inert substances which are brought into the process by the salvaged and waste plastics materials, such as aluminium foils, pigments, fillers, glass fibres.

2.) A condensate, in a quantity of from 10 to 80, preferably 20 to 50% by mass, relative to the mixture of plastics material used, which boils in the region of between 25° C. and 520° C. and may contain up to about 1.000 ppm of organically bound chlorine.

The condensate can be converted into a high-grade synthetic crude oil (syncrude), for example by hydrotreating on fixed-bed commercial Co-Mo or Ni-Mo catalysts, or it can be brought directly into chlorine-tolerating chemico-technical processes or typical oil refinery processes as a hydrocarbon-containing basic substance.

3.) A gas, in quantities from about 5 to 20% by mass, relative to the mixture of plastics material used, which may contain, in addition to methane, ethane, propane and butane, also gaseous halogen hydrides, such as, principally, hydrogen chloride and readily volatile chlorine-containing hydrocarbon compounds.

The hydrogen chloride can be washed, for example with water, out of the gas flow stream to extract a 30%-proof aqueous hydrochloric acid. The residual gas can be freed of the organically bound chlorine, in a hydrogenating treatment in a liquid phase hydrogenation or in a hydrotreater and, for example, directed to a refinery gas processing unit.

In the course of their further processing, the individual product flow streams, in particular the condensate, may subsequently be employed in the sense of a raw-material reutilization, e.g. as starting materials for the production of olefins in ethylene plants.

Figure 3:
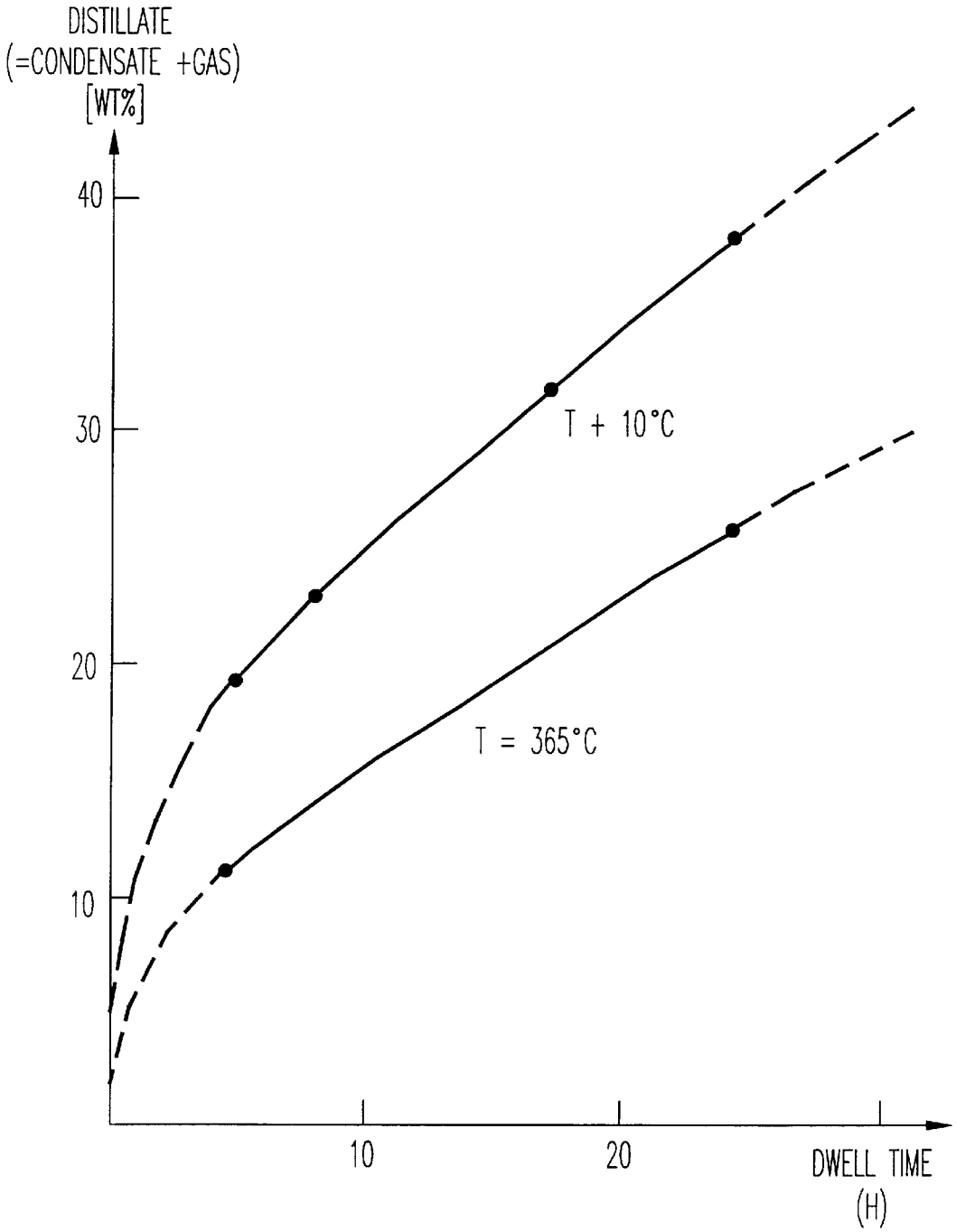
FIG. 3 shows the increase in product yield with respect to residence time for two temperatures using the process of the invention.

An advantage of the process according to the invention resides in that inorganic secondary components of the salvaged or waste plastics materials are upgraded in the liquid phase, whereas the condensate, which does not contain these components, can be processed further by less complicated processes. It is possible to ensure, in particular by the optimal adjustment of the process parameters of temperature and residence time, that, on the one hand, a relatively high proportion of condensate is produced and, on the other hand, the viscous depolymerizate from the liquid phase remains in a state in which it can be pumped under the conditions of the process. A useful approach in this regard is that an increase in the temperature of 10° C., with an average residence time, brings about an increase of more than 50% in the yield of products which pass over into the volatile phase. The dependency on the residence time in respect of two typical temperatures is shown in FIG. 3.

It is possible to optimize the condensate yield additionally by the further preferred features of the process of adding catalysts, stripping with water vapour, light-boiling or hydrocarbon gases, turbulent stirring or pumping over.

A condensate yield of about 50% by mass or more, relative to the total quantity of plastics materials used in the depolymerizing process is typical for the present process. As a result, a considerable relief in the cost-intensive process steps of pressure gasification, liquid phase hydrogenation and low-temperature carbonization (pyrolysis) is, advantageously, obtained.

The temperature range which is preferred for the depolymerization for the process according to the invention is 150° to 470° C. Particularly suitable is a range from 250° to 450° C. The residence time may be 0.1 to 20 hours. A range of from 1 to 10 hours has generally proved to be sufficient. The pressure is a value of less critical importance in the process according to the invention. Accordingly, it may definitely be preferable for the process to be carried out in a partial vacuum, e.g. when volatile components must be drawn off for process-related reasons. Yet relatively high pressures are also feasible, although they necessitate the availability of more apparatus. The pressure would generally be in the region of 0.01 to 300 bar, in particular 0.1 to 100 bar. The process can preferably be carried out well at normal pressure or slightly above normal pressure, e.g. up to about 2 bar, which distinctly reduces the apparatus-related outlay. In order to degas the depolymerizate as completely as possible, and in order to increase the condensate proportion yet further, the process is advantageously carried out in a partial vacuum down to about 0.2 bar.

Depolymerization may preferably be carried out with the addition of a catalyst, for example a Lewis acid such as aluminium chloride, a radical-forming substance such as a peroxide, or a metal compound, for example a zeolite impregnated with a heavy metal salt solution.

Depolymerization may also be carried out under turbulent flow conditions, e.g. by means of mechanical agitators, but also by pumping over the content of the reactor.

Further preferred embodiments of the process involve depolymerization under an inert gas, i.e. a gas which is essentially inert relative to the starting materials and the depolymerization products, e.g. $N_2$, $CO_2$, CO or hydrocarbons. The process may also be carried out with the introduction of stripping gases and stripping vapours, such as nitrogen, water vapour or hydrocarbon gases.

In principle, it may be regarded as an advantage of the process that it is not necessary to add hydrogen in this stage of the process.

Second-hand organic carriers, i.e. carrier wastes, rejected production batches of organic liquids, used oil or fractions from crude oil refining processes, for example a short residue, are suitable as the liquid auxiliary phase, i.e. the carrier or carrier mixture.

It is, however, also possible to dispense with the addition of carriers or extraneous oils or recycled internal oils.

The depolymerization process may be carried out in a conventional reactor, e.g. an agitator vessel reactor with external circulation, which is designed for the corresponding process parameters, such as pressure and temperature, and the vessel material of which is resistant to acid components, such as hydrogen chloride, which may possibly be formed. In particular when depolymerizing takes place with the addition of a catalyst, 'unit operations' processes, which are considered suitable for this purpose, and such as are used for the so-called visbreaking of heavy crude oils or of residues from oil refining, may be considered. It may be necessary for these installations to be adapted according to the requirements of the process according to the invention. This step of the process is advantageously designed for continuous operation, i.e. the plastics material is continuously fed into the liquid phase of the depolymerization reactor, and depolymerizate and tops are drawn off continuously.

In comparison with the subsequent reprocessing steps of low-temperature carbonization, liquid phase hydrogenation or gasification, the apparatus-related outlay is relatively low for the depolymerization process. This holds true, in particular when the process is carried out in the proximity of normal pressure, i.e. in the range from 0.2 to 2 bar. In comparison with the hydrogenating pretreatment, the apparatus-related outlay is also distinctly lower. With optimal control of the depolymerization process, the subsequent process steps may be relieved by up to 50% or more. A high proportion of condensable hydrocarbons, which can be converted into valuable products by known and comparatively simple processes, is simultaneously intentionally formed during the depolymerization.

After separating off of the gas and the condensate, the depolymerizate is simple to handle since it remains in a state in which it can be pumped and, in this state, constitutes a good charge material for the subsequent process steps.

According to the invention, the depolymerizate and the condensate are separately worked up.

The condensable depolymerization products are preferably subjected to a hydrogenating refining process on a fixed-bed granular catalyst. Thus, the condensate may, for example, be subjected to a conventional hydrotreatment, using commercial nickel/molybdenum or cobalt/molybdenum contacts, at partial hydrogen pressures of 10 to 250 bar and at temperatures of 200° to 430° C. In this regard, a guard bed to intercept entrained ash components or coke-forming components is advantageously provided upstream, depending on the composition of the condensate obtained. The contact, as is usual, is arranged on solid bases and the direction of flow of the condensate may be provided to be from the bottom in the direction of the head of the hydrotreating column, or also in the opposite direction. In order to eliminate acid components, such as halogen hydride, hydrogen sulphide, and the like, it is expedient if water, alkali compounds and, possibly, corrosion inhibitors are fed into the condensation part of appropriate separators.

The condensable depolymerization products, or the condensate, may also be subjected to a hydrogenating refining process on a moving-bed catalyst or in a fluid catalyst bed, instead of the hydrotreating process.

After passing through the hydrotreater, the condensate resulting from the depolymerization is, for example, an excellent charging material for a steam cracking unit.

The liquid product which is obtained, for example, in the hydrotreater, is further processed in the usual refinery structures as synthetic crude oil (syncrude) to obtain fuel components, or is used in ethylene plants as a chemical starting material, for example to produce ethylene.

The gaseous components, which are produced during the hydrotreating process, are suitable, for example, to be added to the charged matter for the steam reforming.

In a further preferred embodiment, at least a partial flow stream of the depolymerizate is subjected to pressure gasification.

In principle, all fluidized-bed gasifiers (Texaco, Shell, Prenflo), fixed-bed gasifiers (Lurgi, Espag), and Ziwi gasifiers are suitable as apparatus for pressure gasification. Particularly suitable are processes for the thermal cracking of hydrocarbons with oxygen, such as they are carried out in a combustion chamber in oil gasification processes by the partial oxidation of the hydrocarbons as a flame reaction. The reactions are autothermal, not catalytic.

The crude gas, which is obtained during pressure gasification and essentially comprises CO and $H_2$, may be worked up to synthesis gas or it may be used to produce hydrogen.

In a further preferred embodiment, at least one partial flow stream of the depolymerizate is directed to a liquid phase hydrogenation process. Liquid phase hydrogenation is preferred, in particular, when a large proportion of liquid hydrocarbons are to be produced from the depolymer. With regard to a detailed description regarding the application of a liquid phase hydrogenation process to produce benzene and, optionally, diesel oil from crude oil, reference is made to German Patent No. 933 826.

The liquid phase hydrogenation process of the liquid-viscous depolymer, which is in a state such that it can be pumped, is carried out, for example, such that, if required, mineral-oil-rich short residue is admixed and, after compression to 300 bar, hydrogenation gas is added. For the purpose of preheating, the reaction stock passes through heat exchangers which are connected in series and in which the heat exchange against product flow streams, for example hot-separator tops, takes place.

The reaction mixture, which is typically preheated to 400° C., is heated further to the desired reaction temperature and is then admitted into the reactor or into a reactor cascade in which the liquid phase hydrogenation process takes place.

In a hot separator, which is connected downstream, the separation of the components, which are gaseous at the reaction temperature, from the liquid and solid components takes place under the pressure of the process. Said liquid and solid components also contain the inorganic secondary components.

The relatively heavy oil components are, as a first step, separated from the gaseous portion in a separator and may, after expansion, be directed to an atmospheric distillation.

To begin with, in a downstream separator system, the process gases are removed from that portion which has not been condensed in the above operation, which process gases are reconditioned in a gas-scrubbing procedure and recycled as system gas. The residue of the hot-separator product, for example after further cooling, is stripped of process water and is directed to an atmospheric column for further reprocessing.

The liquid discharge from the hot separator can, expediently, be expanded in two stages and can be subjected to vacuum distillation in order to separate off any residual oil. The concentrated residue, which also contains the inorganic secondary components, may be admitted to the gasification apparatus in liquid or solid form, for the purpose of producing synthesis gas.

The residues (hot-separator residues) obtained in the liquid phase hydrogenation process and the low-temperature carbonization coke obtained in the low-temperature carbonization of the depolymerizate, in each case containing the inorganic secondary components, can be utilized by a further thermal process step in which the residues which are obtained thereby and contain the inorganic secondary components may be worked up further, e.g. for the purpose of recovering metals.

The extracted light-oil and middle-oil portions from the liquid phase hydrogenation process may be used in typical refinery structures as valuable raw materials for the production of fuels or of plastics material precursors such as olefins or aromatic compounds. In the event that these products from the liquid phase hydrogenation process do not have storage stability, they may be subjected to the hydrotreating treatment, which is provided in the present process for the condensate or for the condensable components.

A preferred embodiment of the process according to the invention resides in that the viscous depolymerizate, which is in a state such that it can be pumped, is divided, after separating off the gaseous and condensable depolymerization products, as a liquid product into a partial flow stream which is to be directed to a pressure gasification operation and into a partial flow stream which is to be directed to a liquid phase hydrogenation process.

The division, according to the invention, of the viscous depolymerizate, which is in a state such that it can be pumped, into partial flow streams which are to be directed, respectively, to a pressure gasification operation and a liquid phase hydrogenation process and, optionally, pyrolysis, in conjunction with the separate working-up of the condensable components in a hydrotreating step, results in a considerably improved utilization of the plant. In the case of apparatus such as has been developed for the pressure gasification of solid fuels or for the thermal cracking of hydrocarbons using oxygen, or in plants for the liquid phase hydrogenation of carbon-containing materials under high pressure, what is involved is capital-intensive plant parts, the throughput capacity of which is optimally utilized when they are relieved of charged materials such as those which, in the present process, are previously separated off as the condensate flow stream and are subjected to a separate reprocessing in a hydrotreater unit under comparatively mild process conditions.

A further preferred option of the present process resides in that at least a partial flow stream of the depolymerizate is subjected to low-temperature carbonization, thereby extracting low-temperature carbonization gas, low-temperature carbonization tar and low-temperature carbonization coke.

The condensable hydrogen chloride, which is obtained during depolymerization in gaseous form or in the form of an aqueous solution, may be directed further to a separate utilization in the sense of a use of the material. Remaining portions, which are not components of the depolymerization products, which pass over into a gaseous phase and are condensable as a liquid product yield and which may contain organic chlorine compounds and sulphur-containing and nitrogen-containing compounds, are freed of the heteroatoms chlorine, sulphur, nitrogen or even oxygen, which are separated off as hydrogen compounds, in the course of the liquid phase hydrogenation process or in the residue reprocessing process incorporated therein.

Because of the, at times, significant halogen content of the salvaged plastics materials introduced into the process, it is advantageous to subject the gaseous depolymerization products which are drawn off to a scrubbing operation, whereby, in particular, the halogen hydrides formed are separated off in the form of aqueous halogen hydracid and may be directed towards a utilization of the material.

The gaseous depolymerization products, which may optionally have been freed of acid components such as halogen hydrides, may preferably be supplied to the charged hydrogen gas or to the hydrogen systems gas of the liquid phase hydrogenation process. The same holds true in respect of the low-temperature carbonization gases which are separated off during low-temperature carbonization.

As a result of the combination of depolymerization, hydrogenating treatment of the preferably produced distillate components, liquid phase hydrogenation, gasification (partial oxidation) and/or low-temperature carbonization of the depolymerizate of the liquid phase, it is possible to reduce, as far as capacity is concerned, the last-mentioned treatment steps which are technologically particularly complicated and complex but which tolerate inorganic components. The process according to the invention provides a high potential for reuse of the material of the charged plastics materials.

Thus, with an appropriate combination of the process steps described, it is possible to achieve a practically complete substance utilization of the organic carbon contained in the plastics materials introduced into the process. For the greater part, it is even possible to ensure that the carbon chains or hydrocarbon chains, which are contained in the plastics wastes charged, are obtained and the material is utilized. Even the remaining inorganic components may be directed to a reutilization, e.g. a reclamation of metals. It is also possible, at least in part, to use them again, in ground form, as catalysts in the liquid phase hydrogenation process.

The process according to the invention, with the main plant parts of a depolymerization installation, a hydrotreater, a pressure gasification unit, a liquid phase hydrogenation unit, a low-temperature carbonization unit and the plant parts for the reprocessing of the gaseous depolymerization products, is diagrammatically illustrated in FIG. 1. In FIG. 1, the plant configuration comprising a low-temperature carbonization unit is illustrated in broken lines as an alternative plant component. The distribution of the associated substance flow streams is shown diagrammatically by means of the arrangement of the supply lines illustrated. The reference numbers in FIG. 1 have the following meanings:

1 depolymerization reactor 2 hydrotreater 3 liquid phase hydrogenation unit 4 gasification plant 5 low-temperature carbonization plant 6 salvaged plastics material 7 short residue 8 hydrochloric acid 9 gases (methane, ethane, propane, $H_2$, etc.)

10 condensate 11 depolymerizate 12 gases (methane, ethane, propane, $H_2S$, $NH_3$, $H_2$, etc.) (e.g. to the steam-reforming unit)

13 syncrude II (e.g. to the olefin plant)

14 synthesis gas ($CO/H_2$)

15 slag, carbon black (e.g. to the unit for reclamation of metals)

16 gases (methane, ethane, propane, $H_2S$, $NH_3$, $H_2$, etc.) (e.g. to the steam-reforming unit)

17 syncrude I (e.g. to the refinery)

18 hydrogenation residue (e.g. to the gasification unit)

19 gases (e.g. to the liquid phase hydrogenation unit)

20 tar (e.g. to the liquid phase hydrogenation unit)

21 coke (e.g. to the gasification unit)

A quantity model for the plant configuration according to FIG. 1, is given by way of an exemplified embodiment, as follows, for the above-mentioned charged matter.

The appropriately comminuted, optionally washed and dried, salvaged plastics material is continuously supplied to the depolymerization reactor 1 which is provided with devices for heating, stirring and maintaining the pressure, and with the associated inlet and outlet valves, and with measuring and control devices for the control of the level.

In a typical variation, relative to the total reaction product, 50.0% by mass of depolymerizate, 40.0% of condensate, 5.0% by mass of gaseous hydrogen chloride and 5.0% by mass of other gases are drawn off. The condensate is directed to the hydrotreater 2, from which 35.0% by mass of a syncrude and 5.0% by mass of gaseous reaction products are drawn off overhead, the syncrude being supplied to an olefin plant and the gaseous reaction products being supplied to a steam-reforming unit.

Of the depolymerizate, 25% by mass are admitted to the liquid phase hydrogenation unit 3 and 25% by mass to the gasification unit 4. 25% by mass of the short residue is also admitted to the liquid phase hydrogenation unit 3, as a recycle flow stream. 10% by mass of gaseous reaction products, which are admitted to steam-reforming, 40.0% by mass of a syncrude, which are admitted to a conventional refinery structure, and 5.0% of residue, which may be admitted to the gasification unit 4, are drawn off. The reaction product from the gasification unit, in a typical operating method, comprises 24.0% by mass of a synthesis gas and about 1.0% by mass of an ash-containing carbon black.

Alternatively, the product flow stream of the depolymerizate from reactor 1 may, in part, be admitted to a pyrolysis plant or low-temperature carbonization plant 5 to obtain pyrolysis coke, low-temperature carbonization tar and low-temperature carbonization gas. The pyrolysis coke is admitted to the gasification unit, the low-temperature carbonization tar and the low-temperature carbonization gas are directed to liquid phase hydrogenation.

The concentrated inorganic secondary components in the depolymerizate are concentrated still further in the subsequent reprocessing. If the depolymerizate is admitted to gasification, the inorganic secondary components are subsequently found in the discharged slag. In liquid phase hydrogenation, they are contained in the hydrogenation residue and in low-temperature carbonization in the low-temperature carbonization coke. If the hydrogenation residue and/or the low-temperature carbonization coke are also admitted to gasification, all inorganic secondary components, which are introduced into the process according to the invention, leave reprocessing procedure in the form of gasifier slag.

Figure 2:
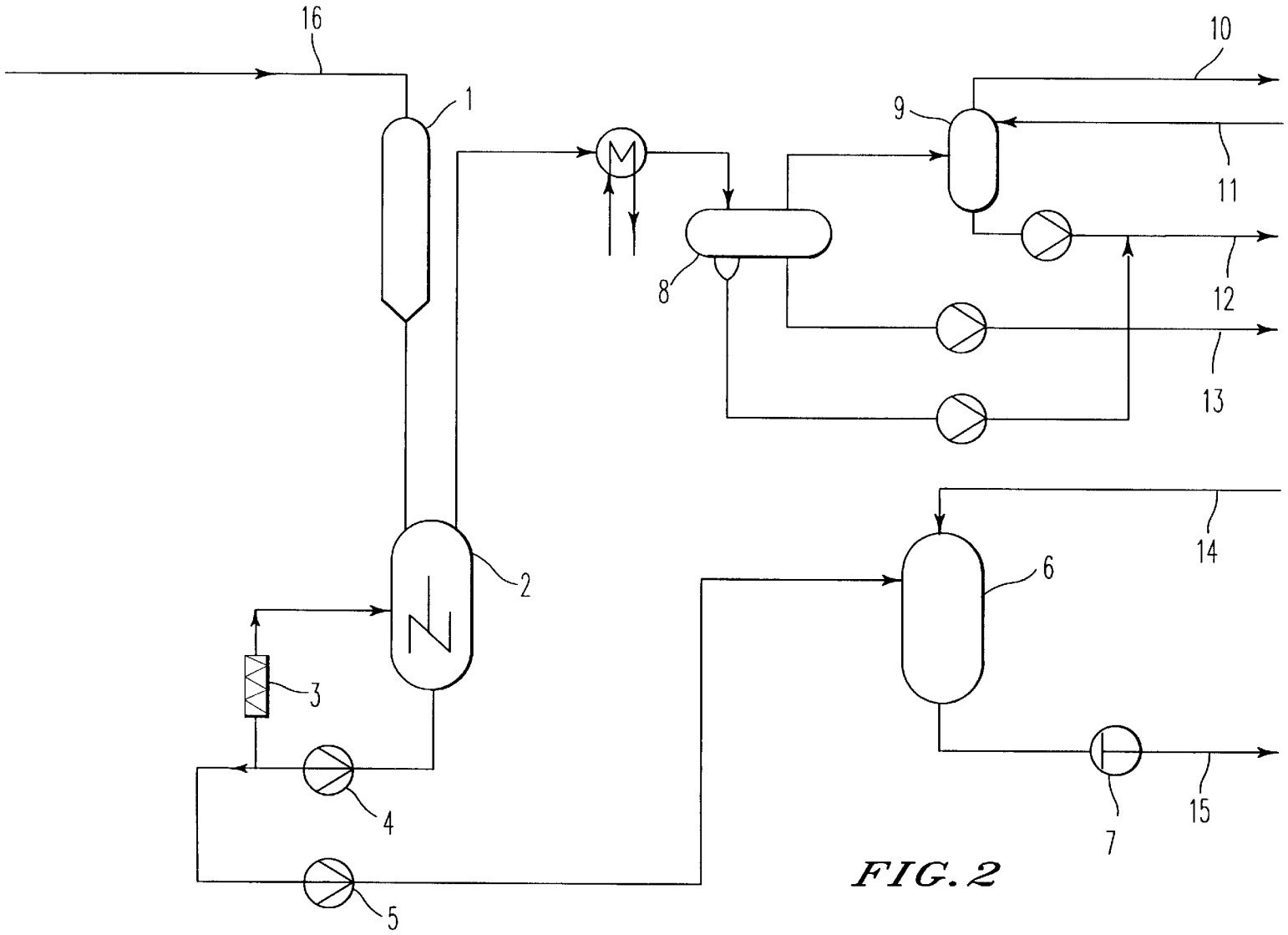
FIG. 2 shows a preferred design of the feed part of a plant for conducting the process of the invention, specifically the feed part for introducing the salvaged or waste plastic materials into the depolymerization plant.

FIG. 2 shows a preferred design of the feed part for the salvaged or waste plastics materials into the depolymerization plant comprising the associated reprocessing part for the gaseous and for the condensable depolymerization products. The reference numbers in FIG. 2 have the following meanings:

1 silo for salvaged plastics material 2 depolymerization reactor 3 furnace 4 circulation pump 5 suspension pump 6 charge container 7 high-pressure pump 8 condenser 9 hydrochloric acid scrubber 10 gases 11 fresh water 12 aqueous hydrochloric acid 13 condensate (e.g. to the hydrotreater)

14 short residue 15 mixture of depolymerizate/short residue (e.g. to the liquid phase hydrogenation plant)

16 conveying means

Salvaged or waste plastics material arrives, via the conveying means 16, in silo 1 and thence in the reactor 2. The reactor content is heated by means of a circulation system comprising a circulation pump 4 and a furnace 3. From this circulation, a flow stream is drawn off via a suspension pump 5, which flow stream is mixed in the charge container 6 with short residue, which is supplied via supply line 14, and is then directed, via high-pressure pump 7 to further processing means. The gases forming in reactor 2 and the condensable portions are directed via the condenser 8 and are separated. After passing through hydrochloric acid scrubber 9, the scrubbed gases 10 are directed toward further utilization. The previously contained acid components are removed after scrubbing in the form of aqueous hydrochloric acid 12. The condensate which is deposited in condenser 8 is directed from said condenser to further utilization.

EXAMPLE 1

Depolymerization of Salvaged Plastics Materials 5 t/h of mixed agglomerated plastics material particles having an average grain diameter of 8 mm are continuously introduced pneumatically into an agitator vessel reactor which has a capacity of 80 $m^3$ and is provided with a circulation system having a capacity of 150 $m^3$/h. The mixed plastics material is material from domestic collections by Duale System Deutschland and typically contains 8% of PVC.

The plastics material mixture was depolymerized in the reactor at temperatures between 360° C. and 420° C. In so doing, four portions were formed, the quantitative distribution of which is set out in the following Table as a factor of the reactor temperature:

| T [°C.] | I gas [% by mass] | II condensate [% by mass] | III depolymer [% by mass] | IV HC1 [% by mass] |
|---|---|---|---|---|
| 360 | 4 | 13 | 81 | 2 |
| 380 | 8 | 27 | 62 | 3 |
| 400 | 11 | 39 | 46 | 4 |
| 420 | 13 | 47 | 36 | 4 |

The depolymerizate flow stream (III) was drawn off continuously and, together with short residue rich in mineral oil, directed to a liquid phase hydrogenation plant for further cracking. The viscosity of the depolymer was 200 mpas at 175° C.

In a separate plant, the hydrocarbon condensates (flow stream II) were condensed and directed to an appropriate further processing in a hydrotreater. The gaseous hydrogen chloride (flow stream IV) was taken up in water and given off as 30%-proof aqueous hydrochloric acid. The hydrocarbon gases (flow stream I) were directed to the liquid phase hydrogenation plant for conditioning.

EXAMPLE 2

Dechlorination of the Condensate

Condensate from a depolymerization plant, which was obtained at a temperature between 400° and 420° C. from a plastics material mixture (DSD domestic collection), was freed of HCl by washing with an ammoniacal solution. It subsequently had a Cl content of 400 ppm.

This thus pretreated condensate was subjected to a catalytic dechlorination process in a continuously operating apparatus. In so doing, the condensate was, as a first step, condensed to 50 bar and subsequently hydrogen was admitted thereto such that a gas/condensate ratio of 1000 1/kg was adhered to. The mixture was heated up and reacted on an NiMo catalyst in a fixed-bed reactor. After leaving the reactor, the reaction mixture was quenched with ammoniacal water, such that the HCl formed passed over completely into the aqueous phase. Prior to expanding the reaction mixture, a gas-phase/liquid-phase separation was carried out, such that it was possible to expand the gas phase and the liquid phase separately. After expanding, the liquid phase was separated into an aqueous phase and an organic phase.

The organic phase, which represented, as far as quantity is concerned, more than 90% by mass of the introduced condensate, showed the following Cl contents ppm, depending on the reaction conditions selected:

| | WHSV [kg oil/kg catalyst/h] | | |
|---|---|---|---|
| Temperature [°C.] | 0.5 | 1 | 2 |
| 370 | — | <1 | 3 |
| 390 | 3 | <1 | <1 |
| 410 | | <1 | <1 |

These condensate grades, under all reaction conditions, meet the supply specifications of a crude oil refinery and can, in said refinery, be directed to top distillation or to specific processing plants (e.g. a steam cracking plant).

We claim:

1. A process for extracting chemical starting materials and liquid fuel components from a salvaged or waste plastic material, comprising the steps of:

depolymerizing a salvaged or waste plastic material to produce a pumpable liquid phase and a volatile phase without the additions of hydrogen; separating said liquid phase from said volatile phase;

further separating said volatile phase into a gaseous phase and a condensate; subjecting said pumpable liquid phase to liquid phase hydrogenation, gassification, low-temperature carbonization or a combination thereof, and subjecting said gaseous phase to a scrubbing step to remove acid components, then subjecting the scrubbed effluent to a liquid phase hydrogenation.

2. The process of claim 1, wherein said depolymerizing is carried out at a pressure of 0.01–300 bar.

3. The process of claim 2, wherein said pressure is 0.1–100 bar.

4. The process of claim 3, wherein said pressure is 0.2–2 bar.

5. The process of claim 1, wherein said depolymerizing is conducted at a temperature of 150°–470° C.

6. The process of claim 5, wherein said temperature is 250°–450° C.

7. The process of claim 1, wherein said salvaged or waste plastic material has a residence time in said depolymerizing step of 0.1–10 hours.

8. The process of claim 7, wherein said residence time is 0.5–5 hours.

9. The process of claim 1, wherein said separating and further separating steps produce a first flow stream comprising 15–85% by mass of a depolymerized pumpable liquid, a second stream comprising 10–80% by mass of a condensate and a third stream comprising 5–20% by mass of a gas mixture, relative to the mass of said salvaged or waste plastic material.

10. The process of claim 1, wherein said depolymerizing is carried out in the presence of a catalyst.

11. The process of claim 1, wherein said depolymerizing is carried out under turbulent flow conditions.

12. The process of claim 1, wherein said depolymerizing is carried out under an inert gas atmosphere.

13. The process of claim 1, further comprising adding a stripping medium to said depolymerizing step.

14. The process of claim 13, wherein said stripping medium is selected from the group consisting of nitrogen, water vapor, hydrocarbon-containing gases and low-boiling hydrocarbon fractions.

15. The process of claim 1, wherein said salvaged or waste plastic material is combined with a liquid carrier in said depolymerizing step.

16. The process of claim 1, wherein said condensate is further subjected to a hydrogenating refining process on a fixed-bed catalyst.

17. The process of claim 1, wherein said condensate is subjected to a hydrogenating refining process on a moving bed catalyst or in a fluid catalyst bed.

* * * * *